US010499167B2

(12) United States Patent
Kuriger et al.

(10) Patent No.: US 10,499,167 B2
(45) Date of Patent: Dec. 3, 2019

(54) METHOD OF REDUCING NOISE IN AN AUDIO PROCESSING DEVICE

(71) Applicant: Oticon A/S, Smørum (DK)

(72) Inventors: Martin Kuriger, Berne (CH); Bernhard Kuenzle, Berne (CH)

(73) Assignee: OTICON A/S, Smørum (DK)

( * ) Notice: Subject to any disclaimer, the term of this patent is extended or adjusted under 35 U.S.C. 154(b) by 93 days.

(21) Appl. No.: 15/838,688

(22) Filed: Dec. 12, 2017

(65) Prior Publication Data

US 2018/0167747 A1 Jun. 14, 2018

(30) Foreign Application Priority Data

Dec. 13, 2016 (EP) ..... 16203593

(51) Int. Cl.
*H04R 25/00* (2006.01)
*H04S 7/00* (2006.01)
*G10L 21/0208* (2013.01)

(52) U.S. Cl.
CPC ..... *H04R 25/505* (2013.01); *G10L 21/0208* (2013.01); *H04R 25/453* (2013.01);
(Continued)

(58) Field of Classification Search
CPC ... G10L 2021/02161; G10L 2021/0216; G10L 2021/02087; G10L 2021/02082;
(Continued)

(56) References Cited

U.S. PATENT DOCUMENTS 9,467,790 B2 * 10/2016 Ojala ..... H04R 29/00
2004/0213415 A1 * 10/2004 Rama ..... G01H 7/00 381/63

(Continued)

FOREIGN PATENT DOCUMENTS

EP 1107472 A2 6/2001
EP 1469703 A2 10/2004

(Continued)

OTHER PUBLICATIONS

Mosayyebpour et al. "Single-Microphone Early and Late Reverberation Suppression in Noisy Speech", IEEE Transactions on Audio, Speech, and Language Processing, vol. 21, No. 2, Feb. 2013, p. 322-335.

*Primary Examiner* — Fan S Tsang
*Assistant Examiner* — Angelica M McKinney
(74) *Attorney, Agent, or Firm* — Birch, Stewart, Kolasch & Birch, LLP

(57) ABSTRACT

The application relates to a method of reducing reverberation in an audio processing device and to an audio processing device. The object of the present application is to provide an alternative method of reducing noise, e.g. reverberation, in a sound signal. The method comprises the steps of a) providing a time variant electric input signal representative of a sound; b) providing a logarithmic representation of said electric input signal; c) providing a predefined statistical model of the likelihood that a specific slope of the logarithmic representation of the electric input signal is due to reverberation; d) identifying time instances of the electric input signal being reverberant according to the statistical model; and e) applying an attenuation to the time instances identified as reverberant. This has the advantage of providing an enhanced sound signal. The invention may e.g. be used for enhancing noisy, e.g. reverberant, signals.

21 Claims, 7 Drawing Sheets
(4 of 7 Drawing Sheet(s) Filed in Color)

(52) U.S. Cl.
CPC .... *H04S 7/305* (2013.01); *G10L 2021/02082* (2013.01); *H04R 25/558* (2013.01); *H04R 2225/41* (2013.01); *H04R 2225/43* (2013.01)

(58) Field of Classification Search
CPC ... G10L 2021/02085; G10L 2021/0208; H04S 7/305; H04S 7/301; G10K 11/002; G10K 15/08; G01H 7/00; H04R 27/00; H04R 29/00
See application file for complete search history.

(56) References Cited

U.S. PATENT DOCUMENTS

2005/0110700 A1 5/2005 Terry
2005/0255843 A1 11/2005 Hilpisch et al.
2010/0027820 A1* 2/2010 Kates ..... G10L 25/00 381/312
2011/0222621 A1 9/2011 Christensen et al.
2011/0255702 A1* 10/2011 Jensen ..... G01H 7/00 381/66
2013/0077798 A1* 3/2013 Otani ..... G10L 21/0208 381/66
2013/0223634 A1* 8/2013 Rieger ..... H04R 25/50 381/23.1
2014/0146987 A1* 5/2014 Pontoppidan ..... H04R 25/30 381/314
2017/0148466 A1* 5/2017 Jackson ..... G10L 25/72
2017/0303053 A1* 10/2017 Falch ..... G10L 21/02

FOREIGN PATENT DOCUMENTS

EP 1777644 A1 4/2007
EP 2573768 A2 3/2013
WO WO 2005/053179 A1 6/2005
WO WO 2005/055654 A1 6/2005
WO WO 2015/024586 A1 2/2015

* cited by examiner

METHOD OF REDUCING NOISE IN AN AUDIO PROCESSING DEVICE

TECHNICAL FIELD

The present application relates to noise reduction in audio processing systems, e.g. to reduction of reverberation, e.g. in hearing devices, such as hearing aids. The disclosure relates specifically to a method of reducing reverberation in an audio processing device.

The application furthermore relates to an audio processing device.

The application further relates to an audio processing system, and to a data processing system comprising a processor and program code means for causing the processor to perform at least some of the steps of the method.

Embodiments of the disclosure may e.g. be useful in applications involving audio processing of noisy, e.g. reverberant, signals. The disclosure may e.g. be useful in applications such as hearing aids, headsets, ear phones, active ear protection systems, handsfree telephone systems, mobile telephones, teleconferencing systems, public address systems, karaoke systems, classroom amplification systems, etc.

BACKGROUND

In reverberant environments, e.g. rooms with hard surfaces, churches, etc., the ability to understand speech declines. This is so because the signal from the target speaker is reflected on the surfaces of the environment; consequently, not only the direct (un-reflected) sound from the target speaker reaches the ears of a user, but also delayed and dampened versions are received due to the reflections. The "harder" a room is, the more reflections.

EP1469703A2 deals with a method of processing an acoustic input signal into an output signal in a hearing instrument. A gain is calculated using a room impulse attenuation value being a measure of a maximum negative slope of the converted input signal power on a logarithmic scale.

SUMMARY

The sound pressure level of reverberation decays exponentially. This implies that the logarithm of the reverberation level decays linearly. This again implies that the slope of the log-level remains more or less constant during the decay. This constant slope of the log-level is what the algorithm is looking for to detect reverberation.

An object of the present application is to provide an alternative method of reducing noise, e.g. reverberation, in a sound signal.

Objects of the application are achieved by the invention described in the accompanying claims and as described in the following.

A Method of Reducing Noise in an Audio Processing Device:

In an aspect of the present application, an object of the application is achieved by a method of reducing reverberation of a sound signal in an audio processing device. The method comprises, providing a reverberation model for a sound comprising
- providing a time variant electric input signal representative of a sound;
- providing a processed representation of said electric input signal according to a first processing scheme;

- providing information about reverberation properties of the processed electric input signal at a given time instance;
- providing a predefined or an online calculated model of a likelihood that a specific slope of the processed representation of the electric input signal is due to reverberation based on said processed electric input signal and said information about reverberation properties;

using the reverberation model on a current electric signal representative of sound comprising
- providing a time variant current electric input signal representative of a sound;
- providing a current processed representation of said current electric input signal according to said first processing scheme;
- determining a current likelihood that a specific slope of the processed representation of said current electric input signal at a current given time instance is due to reverberation using said predefined or online calculated model;
- determining a resulting likelihood based on said current likelihood and corresponding likelihoods determined for a number of previous time instances;
- calculating an attenuation value of the current electric input signal at said current time instance based on said resulting likelihood and characteristics of said current processed representation of the electric input signal;
- applying said attenuation to the current electric input signal at said current time instance providing a modified electric signal.

This has the advantage of providing an enhanced sound signal. Embodiments of the disclosure provides an improved intelligibility of the sound signal.

In an embodiment, the time variant electric input signal is provided as a multitude of input frequency band signals. In an embodiment, the time variant electric input signal and/or the processed representation of the electric input signal is provided as a multitude of input frequency band signals. In an embodiment, the model is in a frequency dependent framework. In an embodiment, the likelihood that a specific slope of the processed representation of the electric input signal at a given time instance is provided as a function of frequency of the signal.

In an embodiment, information about reverberation properties of the processed electric input signal at a given time instance may include the signal to reverberation ratio, the direct to reverberation ratio or the early to late reflection ratio.

In an embodiment, the resulting likelihood of a specific slope of the processed representation of said current electric input signal at a given time instance is due to reverberation is determined from a) the current likelihood and b) corresponding likelihoods determined for a number of previous time instances. In an embodiment, the resulting likelihood is determined from the current likelihood and the current likelihood determined at a number of consecutive previous time instances, e.g. as an average, such as a weighted average.

In an embodiment, 'a specific time instance' refers to a specific time sample of the current electric input signal. In an embodiment, the number of consecutive previous time instances is in the range from 2 to 100 time samples, such as from 20 to 50 time samples.

In an embodiment, a specific time instance refers to a specific time frame of the current electric input signal.

In an embodiment, the term 'likelihood' refers to the likelihood function for which values are limited to the interval between 0 and 1. In an embodiment, the likelihood refers to a logarithmic representation of the likelihood function, e.g. the log-likelihood or the log-likelihood ratio. In an embodiment, the likelihood can assume positive as well as negative values (positive values indicating a larger likelihood than negative values). In an embodiment, the likelihood is limited to taking on values between −1 and +1.

In an embodiment, where the likelihood takes on positive as well as negative values, the resulting likelihood for a given time instance is updated with the current likelihood (instead of having a number of previous likelihood values stored), whereby memory can be saved).

In an embodiment, the characteristics of the processed representation of the electric input signal depends on a noise floor of the signal. In an embodiment, the characteristics of the processed representation of the electric input signal is equal to a noise floor of the signal (e.g. an average level of noise in the processed electric input signal, e.g. the level of the signal during pauses in the target signal, e.g. speech).

In an embodiment, the maximum attenuation value of the current electric input signal associated with a maximum value of the resulting likelihood is configurable.

In an embodiment, the predefined or online calculated model used for identifying time instances of the electric input signal being reverberant is dependent on characteristics of the input signal.

The reverberation model may be defined as a difference between a reverberant speech model and a clean speech model. Hence the reverberation model directly depends on characteristics of the input signal.

In an embodiment, the method comprises determining characteristic of the input signal indicative of a particular sound environment. In an embodiment, the predefined or online calculated model used for identifying time instances of the electric input signal being reverberant at a given point in time is associated with a particular sound environment. In an embodiment, the predefined or online calculated model used at a particular point in time has been trained with sound signals characteristic of the current sound environment.

In an embodiment, the step of providing a processed representation of said electric input signal or of said current electric input signal according to a first processing scheme comprises providing a logarithmic representation of said electric input signal and/or of said current electric input signal, respectively. In an embodiment, providing a processed representation of said electric input signal or of said current electric input signal according to a first processing scheme comprises providing estimating a level of the electric input signal. In an embodiment, providing estimating a level of the electric input signal comprises a rectifying the electric input signal. In an embodiment, providing estimating a level of the electric input signal comprises a smoothing of the electric input signal and/or of the rectified electric input signal.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application. In addition to being stored on a tangible medium such as diskettes, CD-ROM-, DVD-, or hard disk media, or any other machine readable medium, and used when read directly from such tangible media, the computer program can also be transmitted via a transmission medium such as a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

An Audio Processing Device:

In an aspect, an audio processing device is furthermore provided by the present application. The audio processing device comprises

- an input unit providing a time variant current electric input signal representative of a sound;
- a processor providing a current processed representation of said current electric input signal according to a first processing scheme;
- a memory unit comprising a predefined or online calculated model of a likelihood that a specific slope of a processed representation of an electric input signal, processed according to said first processing scheme, is due to reverberation;

The processor is configured to

- determine a current likelihood that a specific slope of the processed representation of said current electric input signal at a current given time instance is due to reverberation using said predefined or online calculated model, to
- determine a resulting likelihood based on said current likelihood and corresponding likelihoods determined for a number of previous time instances; to
- calculate an attenuation value of the current electric input signal at said current time instance based on said resulting likelihood and characteristics of said current processed representation of the electric input signal; and The audio processing device further comprises

- a gain unit for applying said attenuation value to the current electric input signal at said current time instance to provide a modified electric signal.

It is intended that some or all of the structural features of the method described above, in the 'detailed description of embodiments' or in the claims can be combined with embodiments of the device, when appropriately substituted by a corresponding structural feature and vice versa. Embodiments of the device have the same advantages as the corresponding method.

The audio processing device (e.g. the processor) may be configured to execute the (steps of the) method.

The memory unit comprising a predefined or online calculated model of a current likelihood that a specific slope of the current processed representation of the electric input signal, processed according to said first processing scheme, is due to reverberation may be based on the processed electric input signal and information about reverberation properties of said processed electric input signal at a given time instance.

In an embodiment, the audio processing device comprises an output unit for presenting stimuli perceivable to a user as sound based on said modified electric signal.

In an embodiment, the gain unit is adapted to further compensate for a user's hearing impairment.

In an embodiment, the audio processing device comprises a time to time-frequency conversion unit. In an embodiment, the input unit comprises a time to time-frequency conversion unit. In an embodiment, the time to time-frequency conversion unit is adapted to convert a time varying electric signal to a number of time varying electric signals in a number of (overlapping or non-overlapping) frequency bands. In an embodiment, time to time-frequency conversion unit comprises an analysis filterbank. In an embodiment, the time to time-frequency conversion unit comprises a Fourier transformation unit, e.g. a discrete Fourier transformation (DFT) unit. In an embodiment, the electric input signal and/or the processed representation of the current electric input signal is provided in a frequency bands (k=1, . . . , K).

In an embodiment, the audio processing device comprises a classification unit for classifying the current sound environment of the audio processing device. In an embodiment, the audio processing device comprises a number of detectors providing inputs to the classification unit and on which the classification is based. In an embodiment, the audio processing device comprises a voice activity detector, e.g. an own voice detector. In an embodiment, audio processing device comprises a detector of reverberation, e.g. reverberation time. In an embodiment, the audio processing device comprises a correlation detector, e.g. an auto-correlation detector and/or a cross-correlation detector. In an embodiment, the audio processing device comprises a feedback detector. The various detectors may provide their respective indication signals on a frequency band level and/or a full band level.

In an embodiment, the audio processing device comprises a level detector for determining the level of an input signal on a frequency band level and/or of the full signal.

In an embodiment, the memory unit comprises a number of predefined or online calculated models, each model being associated with a particular sound environment or a particular listening situation. In an embodiment, at least one of the predefined or online calculated models is a statistical model. In an embodiment, separate models are provided for different rooms or locations, e.g. such rooms or locations having different reverberation constants, e.g. reverberation time, e.g. T60, e.g. living room, office space, church, cinema, lecture hall, museum, etc. In an embodiment, separate statistical models are provided for specific rooms or locations, where a user is expected to stay, e.g. at his home or at a particular office or private or public gathering place, e.g. a church, or other large room. In an embodiment, a statistical model associated with a particular sound environment or listening situation has been trained with sound signals characteristic of such environment or listening situation.

In an embodiment, the statistical model comprises a model for indicating the likelihood of a given slope to originate from a reverberant or clean signal component. In an embodiment, the statistical model is defined by a log likelihood ratio.

In an embodiment, the audio processing device constitutes or comprises a communication device or a hearing aid.

In an embodiment, the hearing devices comprise an analogue-to-digital (AD) converter to digitize an analogue input with a predefined sampling rate, e.g. 20 kHz. In an embodiment, the hearing devices comprise a digital-to-analogue (DA) converter to convert a digital signal to an analogue output signal, e.g. for being presented to a user via an output transducer.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 40 kHz (adapted to the particular needs of the application) to provide digital samples $x_n$ (or x[n]) at discrete points in time $t_n$ (or n), each audio sample representing the value of the acoustic signal at $t_n$ by a predefined number $N_s$ of bits, $N_s$ being e.g. in the range from 1 to 16 bits. A digital sample x has a length in time of $1/f_s$, e.g. 50 μs, for $f_s$=20 kHz. In an embodiment, a number of audio samples are arranged in a time frame. In an embodiment, a time frame comprises 64 audio data samples (corresponding to 3.2 ms for $f_s$=20 kHz). Other frame lengths may be used depending on the practical application.

In an embodiment, the hearing device comprises a classification unit for classifying a current acoustic environment around the hearing device. In an embodiment, the hearing device comprises a number of detectors providing inputs to the classification unit and on which the classification is based.

In an embodiment, the hearing device comprises a level detector (LD) for determining the level of an input signal (e.g. on a band level and/or of the full (wide band) signal). The input level of the electric microphone signal picked up from the user's acoustic environment is e.g. a classifier of the environment. In an embodiment, the level detector is adapted to classify a current acoustic environment of the user according to a number of different (e.g. average) signal levels, e.g. as a HIGH-LEVEL or LOW-LEVEL environment.

In a particular embodiment, the hearing device comprises a voice detector (VD) for determining whether or not an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only comprising other sound sources (e.g. artificially generated noise). In an embodiment, the voice detector is adapted to detect as a VOICE also the user's own voice. Alternatively, the voice detector is adapted to exclude a user's own voice from the detection of a VOICE. In an embodiment, the hearing device comprises a noise level detector.

In an embodiment, the hearing device comprises an own voice detector for detecting whether a given input sound (e.g. a voice) originates from the voice of the user of the system. In an embodiment, the microphone system of the hearing device is adapted to be able to differentiate between a user's own voice and another person's voice and possibly from NON-voice sounds.

In an embodiment, the audio processing device comprises communication device, such as a cellular telephone, e.g. a SmartPhone. In an embodiment, the audio processing device comprises a hearing device, e.g. a hearing aid, for (at least partially) compensating for a user's hearing impairment. In an embodiment, the hearing device comprises a hearing aid or hearing instrument (e.g. a hearing instrument adapted for being located at the ear or fully or partially in the ear canal of a user or fully or partially implanted in the head of a user), or a headset, or an earphone, or an ear protection device or a combination thereof.

Use:

In an aspect, use of an audio processing device as described above, in the 'detailed description of embodiments' and in the claims, is moreover provided. In an embodiment, use is provided in a system comprising one or more hearing devices, headsets, ear phones, active ear protection systems, cellular telephones, etc. In an embodiment, use is provided in a handsfree telephone system, a teleconferencing system, a public address system, a karaoke system, a classroom amplification system, etc.

An Audio Processing System:

In a further aspect, an audio processing system comprising one or more audio processing devices as described above, in the 'detailed description of embodiments', and in the claims, AND an auxiliary device is moreover provided.

In an embodiment, the audio processing system is adapted to establish a communication link between the hearing device(s) and/or the auxiliary device to provide that information (e.g. control and status signals, possibly audio signals) can be exchanged or forwarded from one to the other.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for allowing a user to select and/or combine an appropriate one of the received audio signals (or combination of signals) for transmission to the hearing device. In an embodiment, the auxiliary device is or comprises a remote control for controlling functionality and operation of the audio processing device (e.g. one or more hearing device(s)). In an embodiment, the function of a remote control is implemented in a SmartPhone, the SmartPhone possibly running an APP allowing to control the functionality of the audio processing device(s) via the SmartPhone (the hearing device(s) comprising an appropriate wireless interface to the SmartPhone, e.g. based on Bluetooth or some other standardized or proprietary scheme). In an embodiment, the auxiliary device is or comprises a cellular telephone, e.g. a SmartPhone or similar device.

In the present context, a SmartPhone, may comprise

- a (A) cellular telephone comprising a microphone, a speaker, and a (wireless) interface to the public switched telephone network (PSTN) COMBINED with
- a (B) personal computer comprising a processor, a memory, an operative system (OS), a user interface (e.g. a keyboard and display, e.g. integrated in a touch sensitive display) and a wireless data interface (including a Web-browser), allowing a user to download and execute application programs (APPs) implementing specific functional features (e.g. displaying or using information retrieved from the Internet, remotely controlling another device, combining information from various sensors of the smartphone (e.g. camera, scanner, GPS, microphone, etc.) and/or external sensors to provide special features, etc.).

In an embodiment, the audio processing device comprises a hearing device, e.g. a hearing aid, for (at least partially) compensating for a user's hearing impairment.

In an embodiment, the audio processing system comprises two hearing devices adapted to implement a binaural hearing system, e.g. a binaural hearing aid system.

An APP:

In a further aspect, a non-transitory application, termed an APP, is furthermore provided by the present disclosure. The APP comprises executable instructions configured to be executed on an auxiliary device to implement a user interface for a hearing device or a hearing system described above in the 'detailed description of embodiments', and in the claims. In an embodiment, the APP is configured to run on cellular phone, e.g. a smartphone, or on another portable device allowing communication with said hearing device or said hearing system.

In an embodiment, the APP is configured to allow a user to select one out of a predefined set of environments to optimize the reverberation reduction settings (e.g. selecting one out of a number of appropriate models adapted for a particular acoustic environment, and/or algorithms and/or algorithm settings).

In an embodiment, the model or algorithms or algorithm settings are linked to geo-location data.

In an embodiment, the APP is configured to receive inputs for one or more detectors sensing a characteristic reverberation in the present location, or from other 'classifiers' of the acoustic environment, In embodiment, the APP is configured to propose an appropriate current environment.

In embodiment, the APP is configured to allow the user to control the maximum amount of attenuation allocated to a maximum likelihood of reverberation.

Definitions

In the present context, a 'hearing device' refers to a device, such as a hearing aid, e.g. a hearing instrument, or an active ear-protection device, or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with an output transducer, e.g. a loudspeaker, arranged close to or in the ear canal, as a unit entirely or partly arranged in the pinna and/or in the ear canal, as a unit, e.g. a vibrator, attached to a fixture implanted into the skull bone, as an attachable, or entirely or partly implanted, unit, etc. The hearing device may comprise a single unit or several units communicating electronically with each other. The loudspeaker may be arranged in a housing together with other components of the hearing device, or may be an external unit in itself (possibly in combination with a flexible guiding element, e.g. a dome-like element).

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit for processing the input audio signal and an output unit for providing an audible signal to the user in dependence on the processed audio signal. The signal processor may be adapted to process the input signal in the time domain or in a number of frequency bands. In some hearing devices, an amplifier and/or compressor may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output unit may comprise an output transducer, such as e.g. a loudspeaker for providing an air-borne acoustic signal or a vibrator for providing a structure-borne or liquid-borne acoustic signal. In some hearing devices, the output unit may comprise one or more output electrodes for providing electric signals (e.g. a multi-electrode array for electrically stimulating the cochlear nerve).

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory brainstem, to the auditory midbrain, to the auditory cortex and/or to other parts of the cerebral cortex.

A hearing device, e.g. a hearing aid, may be adapted to a particular user's needs, e.g. a hearing impairment. A configurable signal processing circuit of the hearing device may be adapted to apply a frequency and level dependent compressive amplification of an input signal. A customized frequency and level dependent gain may be determined in a fitting process by a fitting system based on a user's hearing data, e.g. an audiogram, using a fitting rationale. The frequency and level dependent gain may e.g. be embodied in processing parameters, e.g. uploaded to the hearing device via an interface to a programming device (fitting system), and used by a processing algorithm executed by the configurable signal processing circuit of the hearing device.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. SmartPhones), or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person. Hearing devices or hearing systems may e.g. form part of or interact with public-address systems, active ear protection systems, handsfree telephone systems, car audio systems, entertainment (e.g. karaoke) systems, teleconferencing systems, classroom amplification systems, etc.

Further objects of the application are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element or intervening elements may be present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The patent or application file contains at least one color drawing. Copies of this patent or patent application publication with color drawing will be provided by the USPTO upon request and payment of the necessary fee.

The disclosure will be explained more fully below in connection with a preferred embodiment and with reference to the drawings in which.

A) Attenuation is limited by a constant value of 14 dB.

B) Attenuation is limited by both a constant value of 14 dB and the SNR

Figure 5A:
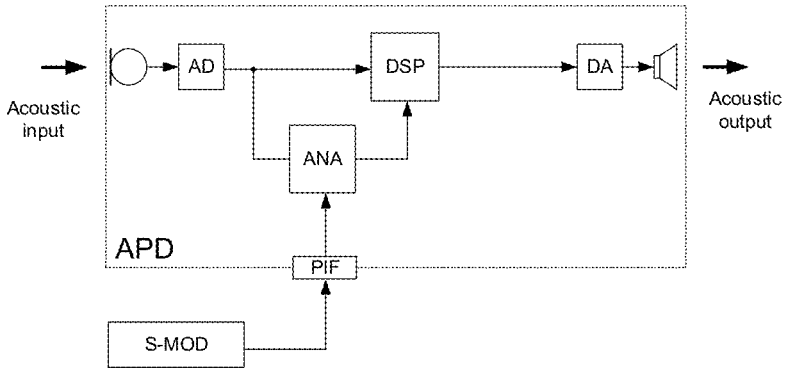
Figure 5B:
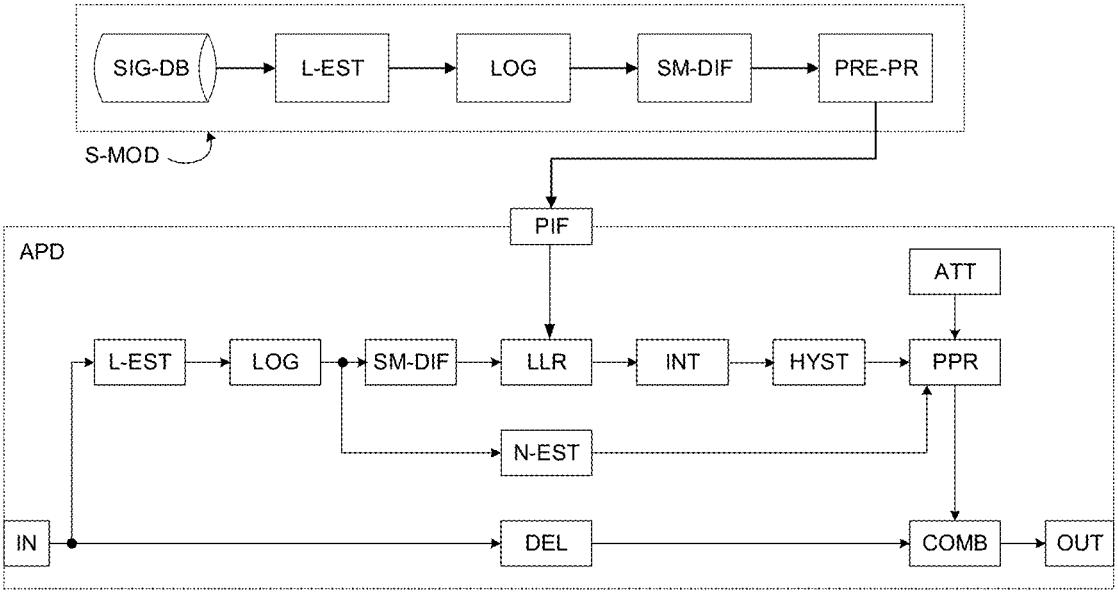
Figure 6:
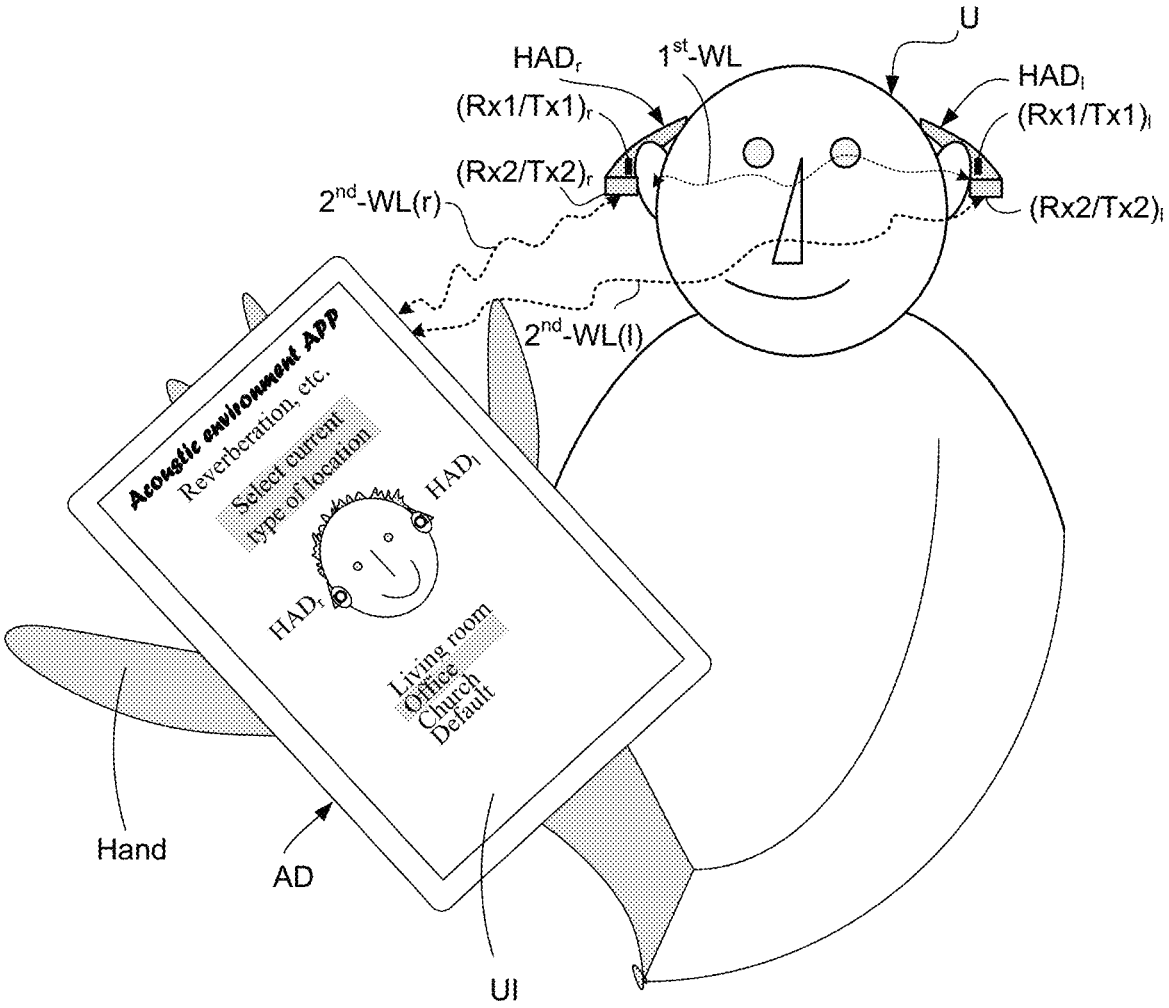
Figure 7:
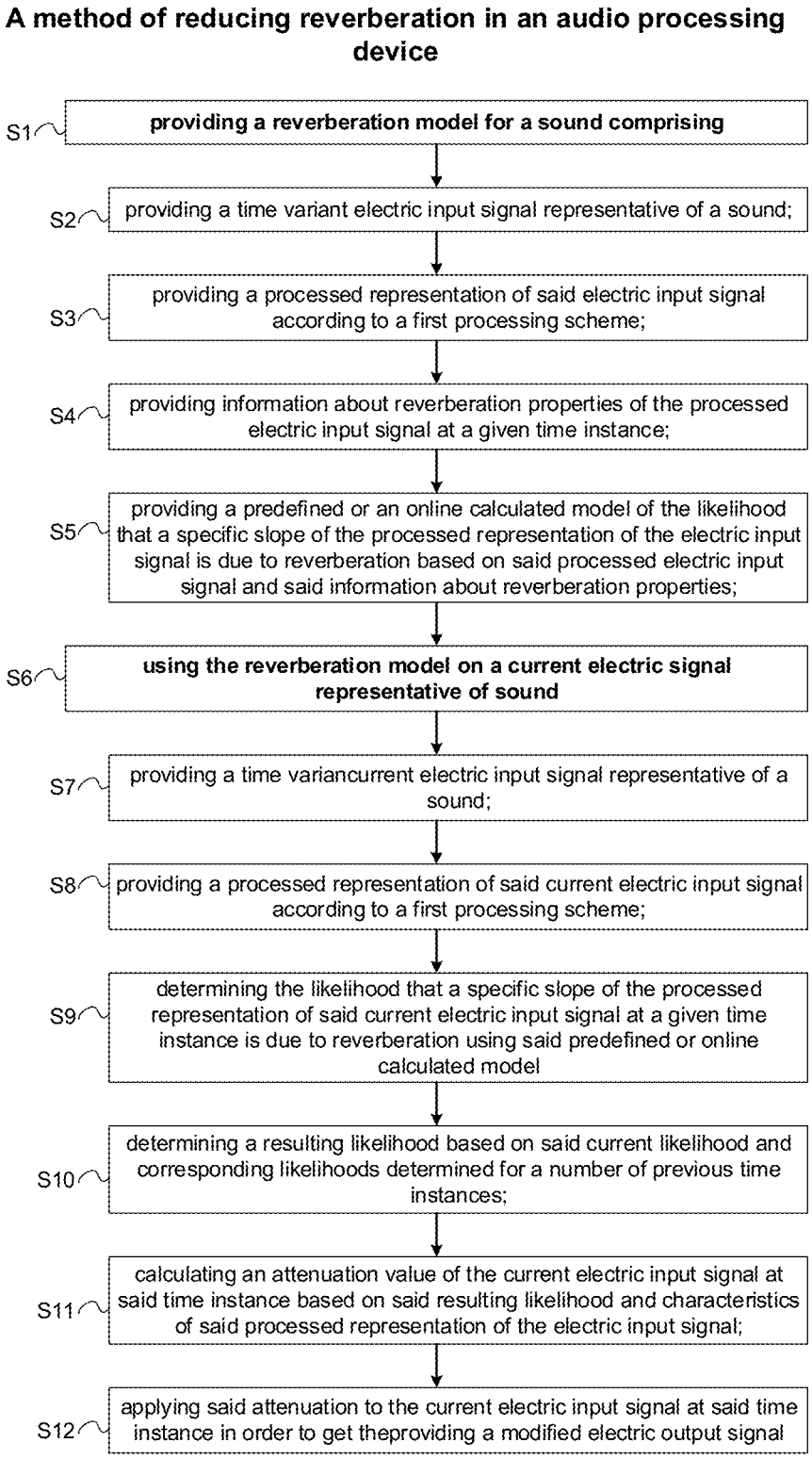

C) Attenuation is limited by both a constant value of 14 dB and 0.5*SNR,

FIGS. 5A, 5B shows a block diagram representing a signal flow of the proposed algorithm as implemented in an embodiment of an audio processing device, FIG. 5A giving an overview, and FIG. 5B a more detailed view, FIG. 6 shows an embodiment of an audio processing system comprising first and second hearing devices and an auxiliary device comprising a user interface for the audio processing system, and FIG. 7 shows a flow diagram for a method of reducing reverberation in an audio processing device according to an embodiment of the present disclosure.

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The elements and principles disclosed in the following description of an example of an embodiment of the present disclosure dealing with reverberation reduction may alternatively be used in other algorithms dealing with noise reduction (in particular such algorithms where the occurrence of the noise and the slope of the signal level are related to each other). Such types of noise may e.g. include transient noises.

Embodiments of an audio processing algorithm (implementing steps of the method) or an audio processing device according to the present disclosure can be classified by the following aspects or features:

Minimum number of microphones needed is one.

Acts only on late reflections.

No impulse response needs to be estimated.

No reverberation time needs to be estimated.

May operate in different frequency bands.

Other Characteristics May Include

The algorithm is 'always on'. There is no environment detection that disables the algorithm, if no reverberation is present. Hence, the reverberation estimation should preferably be accurate enough to prevent artifacts in reverb-free environments.

The algorithm buffers the information of only one past sample per frequency channel. One past sample is needed to calculate the slope between the current and the past sample. For every new sample arriving at the input, the algorithm immediately calculates the slope and based on this it estimates the reverberation likelihood and applies the corresponding attenuation value in every frequency channel.

Statistical Model

The algorithm does not explicitly estimate the reverberation time of the current environment. Instead, it uses a predefined statistical model of the likelihood that a specific slope is reverberant. The intuition behind this model is the following: The slopes of the log-level remain nearly constant during the decay of the reverberation. If a histogram of the individual log-level-slopes of a reverberant signal is created, where 'creating a histogram' means counting the number of occurrences of each slope, a bump (or peak) at a location that corresponds roughly to the reverberation decay slope will be observed. A histogram of the slopes of a clean signal does not show such a bump. Hence, by comparing the "log-level-slope-histograms" of clean and reverberant signals, it can be determined for every specific slope whether it is more likely to refer to a reverberant or clean signal. This scheme is intended to provide guidance to building the required (predetermined) statistical model.

A predefined model or an online generated model (e.g. a statistical model) of the likelihood that a specific slope of the logarithmic representation of an electric input signal is reverberant may be generated in a number of ways. In an embodiment, such method of generation includes the following steps:

Providing a time variant clean first sound signal (free of reverberation);

Providing a number of noisy versions of the same first sound signal comprising various degrees of reverberation;

Calculating the first order derivative of the smoothed log level of the clean and reverberant signals in several frequency channels.

Creating a histogram of the slopes for clean and reverberant signals by counting the number of occurrences of each slope. These histograms represent the likelihood that a certain slope occurs given that the signal is clean or reverberant.

Creating the log likelihood ratio of the two histograms by dividing the reverberant histogram by the clean histogram and taking the logarithm of the result.

The log likelihood ratio is the statistical model that can be used to determine whether a certain slope is more likely to be reverberant or not. A positive value indicates reverb, a negative value indicates a clean signal. The magnitude of the value indicates how certain the model is, the bigger the value, the more certain.

Figure 1A:
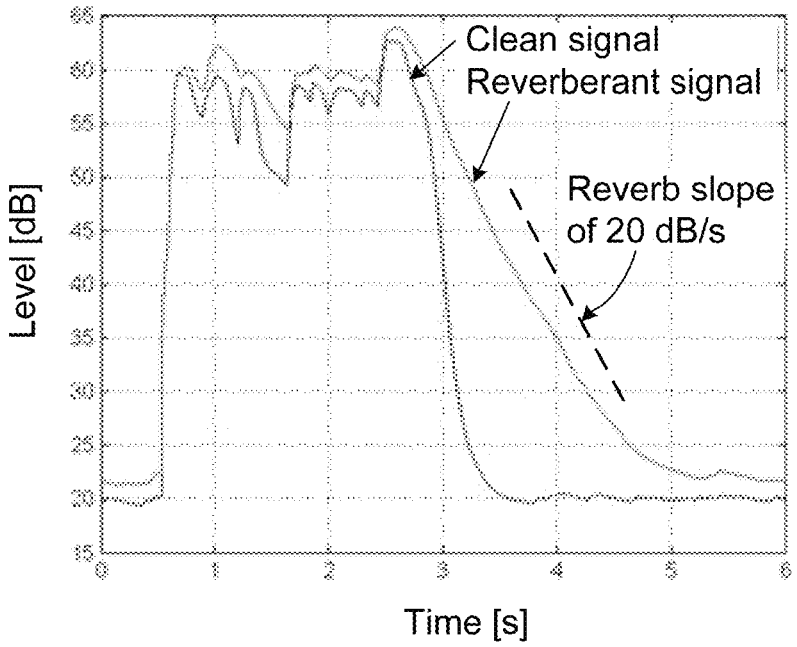
FIGS. 1A, 1B show the log-levels (FIG. 1A) and the log-level-slope-histograms (FIG. 1B) of a clean and a reverberant signal.
Figure 1B:
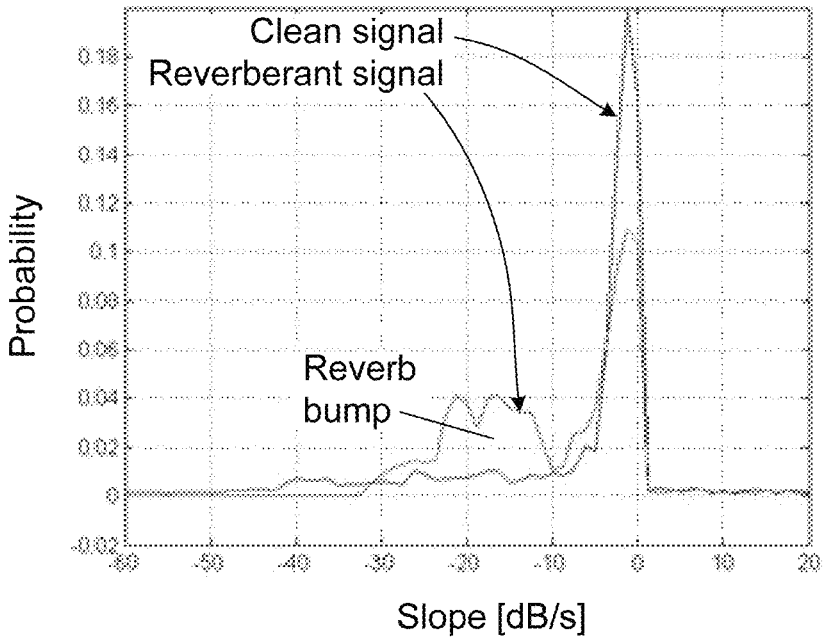

FIGS. 1A, 1B shows the log-levels (FIG. 1A) and the log-level-slope-histograms (FIG. 1B) of a clean and a reverberant signal. The two graphs in FIG. 1A show the log-level (Level in dB, between 15 dB and 65 dB) of a clean speech signal (lower curve denoted 'Clean signal') and a reverberant speech signal (uppermost curve denoted 'Reverberant signal') versus time (Time, linear scale in s, between 0 and 6 s). Note the nearly constant slope of the reverberant signal of about −20 dB/s in the right part of FIG. 1A (from app. time of 3 s to app. time of 4.5 s). FIG. 1B shows the histogram of the slopes of the same two signals ('Clean signal') and 'Reverberant signal'), each curve indicating the probability of a the signal in question having a given slope. The vertical axis (denoted Probability) indicates a probability on a linear scale between −0.02 and 0.18. The horizontal axis (denoted Slope) indicates a slope in dB/s between −60 dB/s and +20 dB/s. Both curves exhibit a clear peak around negative slopes in the range from −5 dB/s to 0 dB/s. Note the "reverberation bump" of the curve Reverberant signal at around −20 dB/s (in the range from −30 dB/s to −10 dB/s).

Improved Statistical Model

Weight Function

We can improve the statistical model if we focus on the essential part, the reverberation. We still want to create a clean and a reverberant histogram but we now take into account the actual amount of reverberation at every individual sample. To achieve this we have to calculate a new signal, a so-called weight function, which combines the information about how much signal we have and how reverberant it is. And here's how it can be done:

| | Explanation | Formula (Matlab style) |
|---|---|---|
| 1. | Take a clean input signal (C) and create several (n) processed copies (Pn) with different amounts of reverberation (ranging from no reverberation | C = clean input Signal<br>Pn = Processed signals<br>RIRn = Room Imp. Resp. |

-continued

| | Explanation | Formula (Matlab style) |
|---|---|---|
| | to very much reverb). Adding reverberation can be done using any kind of audio processing software (e.g. Adobe Audition) or by convolving the input signal with different room impulse responses (RIRn) within Matlab. | Pn = conv(C, RIRn); |
| 2. | Calculate the smoothed level of the input signal (lvlC) and the processed signals (lvlPn). Based on this determine the level of the added reverberation (lvlRn) for every processed signal. | lvlC = smooth($C^2$);<br>lvlPn = smooth($Pn^2$);<br>lvlRn = lvlPn − lvlC; |
| 3. | Convert everything to logarithmic scale (in dB). | dbC = 10 * log10(lvlC);<br>dbPn = 10 * log10(lvlPn);<br>dbRn = 10 * log10(lvlRn); |
| 4. | Calculate the different signal to reverberation ratios (SRRn) by subtracting the reverberation levels from the clean signal level. | SRRn = dbC − dbRn; |
| 5. | Calculate the different signal to noise floor ratios (SNRs) by subtracting the noise floor from every processed signal. | SNRn = dbPn − min(dbPn); |
| 6. | Calculate different weight functions (Wn) which combine the clean signal to reverberation ratios (SRRn) and the corresponding processed signal to noise ratios (SNRn) for every sample. The function tanh( ) limits the SRR to values in the interval [−1 1]. | Wn = tanh(SRRn) .* SNRn; |

Weight Function Intuition

The intuition behind this weight function is the following: We want to pay more attention to samples that have much higher level than the noise floor. If such a signal sample contains mainly reverberation, it should be attenuated (a lot). On the other hand, if it is completely reverberation free it should not be attenuated (at all). We do not care so much about signal samples with a level close to the noise floor, no matter whether they are clean or not. To sum up, the calculated weight function has the following properties:

- It is positive if the signal to reverberation ratio is positive, i.e. if the clean signal level is higher than the level of the reverberation. Otherwise, it is negative.
- Its absolute value is big (positive or negative) if the signal to noise floor ratio is big.
- Therefore it indicates to which histogram (clean or reverberant) a particular slope should contribute and it shows how important that particular slope is for the corresponding histogram.

Normalized, Weighted Histograms

We can now return to create histograms like in the beginning. However, instead of making the histogram of the slopes of a complete signal we can now make a histogram of only the clean and only the reverberant slopes. This is possible because for every single slope of the processed signals we have a corresponding weight function value that tells us whether this slope is reverberant or not. Furthermore, we can weight every slope by the amount of the weight function (as the name suggests). A reverberant slope with a big (negative) weight function value will therefore contribute more to the reverberant histogram than a same slope with low weight function value. The same applies for the clean slopes. The resulting histograms have to be normalized to sum up to one in order to represent a valid probability distribution. In addition, the sign of the reverberant histogram needs to be inverted to get positive values.

Figure 2:
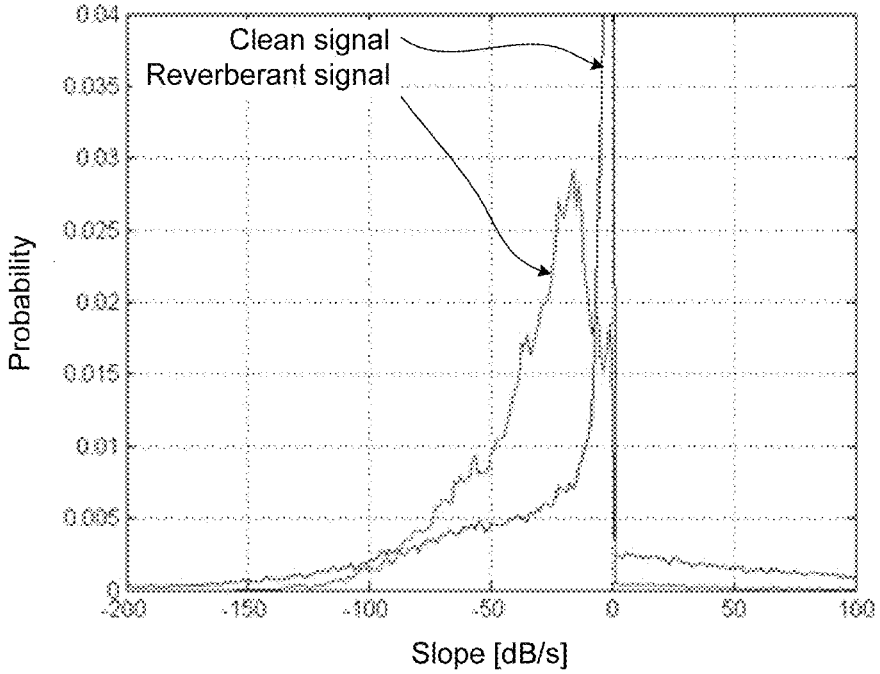
FIG. 2 shows weighted and normalized histograms of the clean and the reverberant slopes of a set of test signals.

FIG. 2 shows weighted and normalized histograms of the clean and the reverberant slopes of a set of test signals. The test signals consisted of a clean OLSA sentence test signal (72 sec long) plus four copies with reverberation amounts from short (RT60=1 sec) to long (RT60=4 sec) reverberation time.

Log Likelihood Ratio

The probability distributions shown in the histograms in FIG. 2 can also be interpreted in terms of likelihood. The height of the two curves shows the likelihood that the corresponding slope is clean or reverberant. Of course it's somehow tedious to compare every slope with two separate histograms. It's possible to combine both histograms in one convenient model: the Log Likelihood Ratio (LLR). We calculate the LLR as follows:

$$LLR = \log\left(\frac{|\mathrm{Hist}_{Reverb}|}{\mathrm{Hist}_{Clean}}\right)$$

Figure 3:
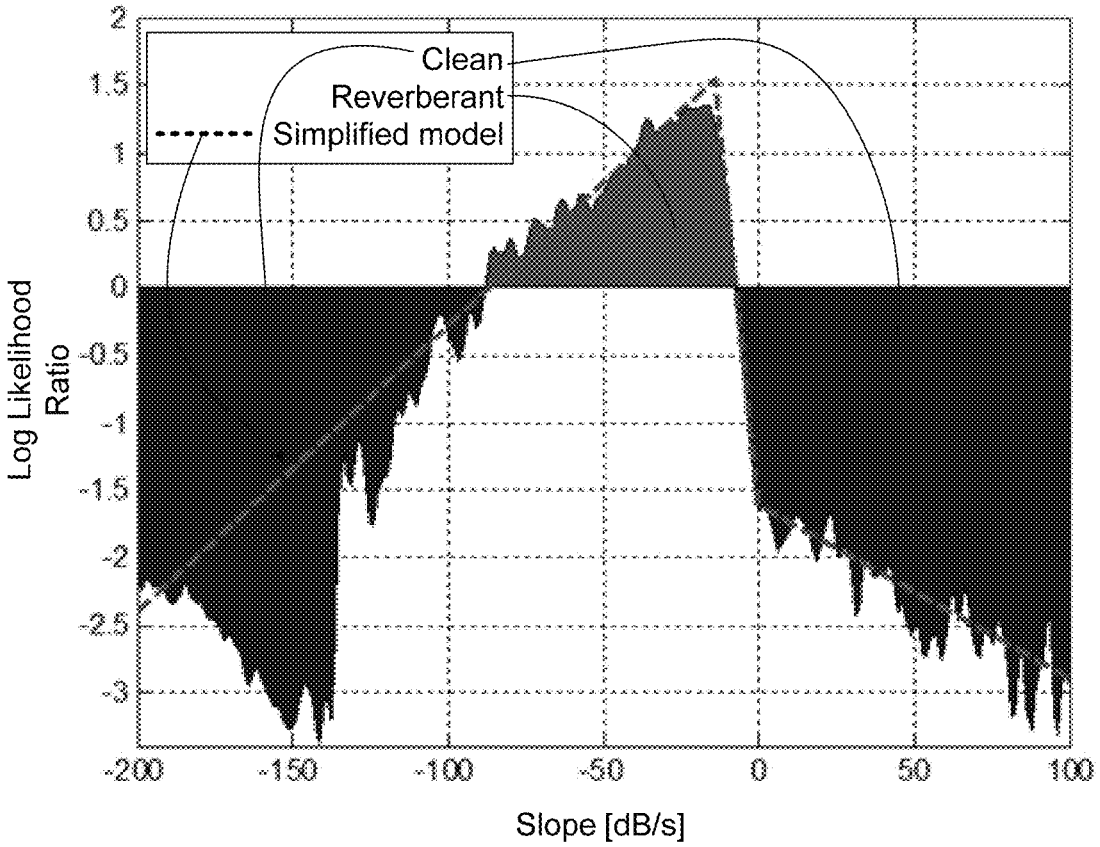
FIG. 3 illustrates the log likelihood ratio of the calculated model (histograms of FIGS. 1A, 1B and 2)

FIG. 3 shows the log likelihood ratio of the calculated model (histograms of FIG. 1A, 1B and FIG. 2). It shows the likelihood that a single slope is either clean (blue) or reverberant (green). We can see that the model shows regions of more or less linear relationship between the slope and the log likelihood ratio. This circumstance can be exploited to build a simplified version of the LLR model (dashed red line). This simplified model is still a good approximation and can be stored using only a few data points.

From Log Likelihood Ratio to Reverberation Attenuation

Of course we don't really want to know the likelihood of having reverberation for each individual sample. Instead, we are looking for the average likelihood of having reverberation at a specific moment, depending on the current but also on the past samples. To get the average likelihood of having reverberation we simply scale the LLR values by some constant (to control the estimation speed) and sum them up in a double-bounded integrator (e.g. bounded to values between [0 . . . 1]). If the output value of this integrator increases, it indicates that the reverberation likelihood increases. The magnitude of the integrator output therefore indicates how sure we are that the current signal consists of reverberation. The maximum value of the integrator output is 1, therefore we can simply multiply it with our desired maximum attenuation to get the final reverberation attenuation values.

SNR Dependent Maximum Attenuation

A reverberant signal consists not only of signal and reverberation but also of a more or less constant noise floor. This noise floor can be due to microphone noise or any kind of unmodulated background noise. If we now detect reverberation and attenuate it by a too big amount it is possible that the output level will drop below the noise floor. This attenuation strategy generally leads to unnatural sound artifacts. A good alternative is to restrict the maximum possible attenuation to be smaller or equal to the actual SNR. In this case we can't attenuate to a level below the noise floor. In reality, with this strategy we can still hear artifacts, even though they're reduced a lot. In the current setup of the algorithm the attenuation is limited to an even lower value of 0.5*SNR.

Figure 4:
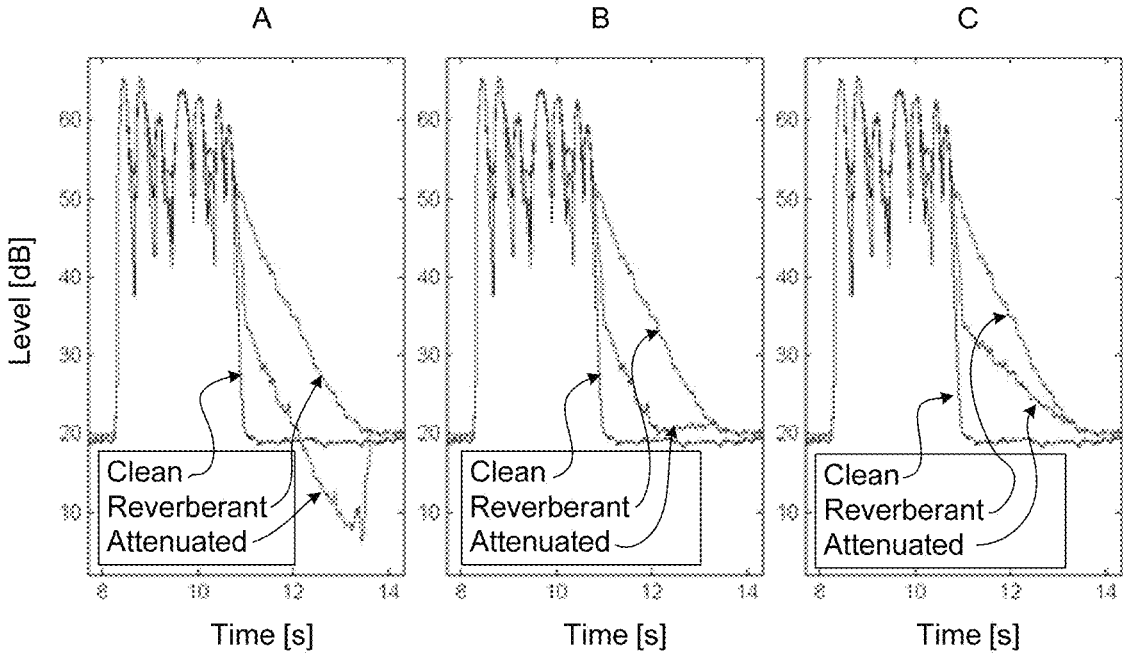
FIG. 4 illustrates different strategies to limit the applied attenuation.

FIG. 4A, 4B, 4C shows different strategies to limit the applied attenuation:

Attenuation is limited by a constant value of 14 dB.

Attenuation is limited by both a constant value of 14 dB and the SNR

Attenuation is limited by both a constant value of 14 dB and 0.5*SNR.

It seems obvious that the attenuation strategy in the plot A) creates audible artefacts when the attenuation is released. In plot B) these artifacts are already greatly reduced. The attenuation strategy in plot C) reduces the artifacts even more resulting in a very natural sound quality despite a very strong attenuation of 14 dB.

The plots in FIGS. 4A, 4B and 4C show the different attenuation strategies and how the output level (shown in red) looks like.

Optimizations

Reverberation Estimation Hysteresis

There's a small problem with the algorithm as it is described until now: The level of every clean signal has large positive (rising) and large negative (falling) slopes. When changing from a rising to a falling slope, there will be some "most likely reverberant" slopes according to the LLR in FIG. 3. The signal will therefore be mistakenly attenuated during a short moment. This behavior doesn't depend on the signal or the environment but is a conceptual problem. To overcome this weakness we introduce a hysteresis into the reverberation estimation. The reverb estimator has to reach a certain level of certainty before any attenuation can be applied. This resolves the problem.

Asymmetric Smoothing in Log Domain

One might have noticed that the histograms of the log-level slopes show somehow strange distributions for clean signals. One may expect a distribution that is close to a normal distribution but in fact they are not even symmetrical. That's because the levels have been smoothed using a $1^{st}$ order asymmetric smoother. The filter is designed in a way that positive slopes aren't smoothed at all (to catch every single peak) while negative slopes are smoothed by some specified smoothing factor. This smoothing is required because the $1^{st}$ order difference of the log-level is very noisy. In theory the log-level slope should be a constant value during the reverberation decay. Due to the noise, however, it is actually distributed over a large value range with its mean more or less at the theoretical constant value. Smoothing the log-level slopes will therefore filter out the noise so that we have access to the nearly constant slope value.

Summary

The statistical model of the Log Likelihood Ratio (LLR) is the core element of the proposed reverberation reduction algorithm. The model is calculated based on a selection of clean and reverberant input signals. Based on this predefined LLR model, the algorithm determines the likelihood that an incoming sample is reverberant. The cumulative sum of continuous LLR values gives a good estimate of how certain it is that the signal consists of reverberation. This estimate can then be multiplied with a SNR dependent maximum attenuation value to calculate the effective attenuation to reduce the reverberation.

FIG. 5A, 5B each shows a block diagram representing a signal flow of the proposed algorithm as implemented in an embodiment of an audio processing device, e.g. a hearing aid, FIG. 5A giving an overview, and FIG. 5B a more detailed view. The solid outline box denoted APD in FIGS. 5A and 5B indicates the signal processing that is performed inside the audio processing device (APD), e.g. a hearing instrument, during runtime. The S-MOD units of FIGS. 5A and 5B are e.g. executed offline and define the LLR function that will be used by the algorithm. Note the equivalence of the slope calculation blocks in the pre-processing and the hearing aid path. It is advantageous that the preprocessing path applies the same slope calculation as the algorithm does in the hearing aid in order to get a representative statistical model. The underlying data to calculate this statistical model comes from a signal data base (SIG-DB) comprising a number of signal pairs with and without reverberation. The signals with reverberation can be recorded or generated by convolving the dry signals with room impulse responses. In an embodiment, the input unit (IN in FIG. 5B, e.g. the AD converter AD in FIG. 5A) comprises a filterbank for providing the electric input signal in a number of frequency bands (k=1, . . . , K). Alternatively, the hearing device may comprise other time domain to frequency domain conversion units, located appropriately in the device, e.g. to optimize power consumption). The level estimator block (L-EST) and the logarithm block (LOG) convert the input signals into smoothed level signals in the log domain. The next block is a smoothed differentiator (SM-DIFF) and calculates a smoothed version of the first order derivative of the signal level. Based on these signals, the preprocessing block (PRE-PR) creates the statistical model that is then saved to the audio processing device via a programming interface (PIF). Inside the audio processing device, the same blocks (L-EST, LOG and SM-DIF) build the first part of the signal processing chain. The output of the SM-DIF block is converted to a corresponding log likelihood ratio (LLR) which is then integrated using a bounded integrator (INT). The hysteresis block (HYST) reduces false attenuation for non-reverberant signals. Finally, a post processing block (PPR) converts the signal from the HYST block into an applicable attenuation using a predefined maximum attenuation (ATT) and an estimated noise floor (N-EST). The applicable attenuation is combined (COMB) on the delayed (DEL) input signal and sent to the output stage (OUT).

FIG. 6 shows an embodiment of an audio processing system comprising first and second hearing devices ($HAD_l$, $HAD_r$) (e.g. $1^{st}$ and $2^{nd}$ hearing aids) and an auxiliary device (AD) comprising a user interface (UI) for the audio processing system. Via the user interface (UI, e.g. implemented via a touch sensitive display of a smartphone and an APP executed on the smartphone, here denoted Acoustic environment APP, Reverberation etc.) the user (U) may select one out of a predefined set of environments (cf. text on screen Select current type of location, here exemplified by the choices Living room, Office, Church, Default) to optimize the reverb reduction settings (e.g. selecting different models and/or algorithms and/or algorithm settings). These settings could also be linked to geo-location data, such that the APP automatically enables the church settings when the user is in the church. Alternatively or additionally, the environment could be sensed by detectors sensing a characteristic reverberation in the present location (e.g. by issuing a test signal, and measuring a reflected signal by a respective loudspeaker and microphone of the smartphone). Other 'classifiers' of the acoustic environment, e.g. provided by the present APP or another APP of the smartphone, may be used to identify the current environment. In embodiment, an appropriate current environment is proposed by the APP, possibly leaving the final choice or acceptance to the user. The APP may also be configured to allow the user to control the amount of attenuation he or she needs. Finally, the APP may be configured to show the activity of the algorithm using some sort of live-view of the applied attenuation.

The left and right hearing devices ($HAD_l$, $HAD_r$) are e.g. implemented as described in connection with FIG. 5A or 5B. In the embodiment of FIG. 6, the binaural hearing assistance system comprises an auxiliary device (AD) in the form of or comprising a cellphone, e.g. a SmartPhone. The left and right hearing devices ($HAD_l$, $HAD_r$) and the auxiliary device (AD) each comprise relevant antenna and transceiver circuitry for establishing wireless communication links between the hearing devices (link $1^{st}$-WL) as well as between at least one of or each of the left and right hearing devices and the auxiliary device (cf. links $2^{nd}$-WL(l), and $2^{nd}$-WL(r), respectively). The antenna and transceiver circuitry in each of the left and right hearing devices necessary for establishing the two links is denoted $(Rx1/Tx1)_l$, $(Rx2/Tx2)_l$ in the left, and $(Rx1/Tx1)_r$, $(Rx2/Tx2)_r$ in the right hearing device, respectively, in FIG. 6.

In an embodiment, the interaural link $1^{st}$-WL is based on near-field communication (e.g. on inductive coupling), but may alternatively be based on radiated fields (e.g. according to the Bluetooth standard, and/or be based on audio transmission utilizing the Bluetooth Low Energy standard). In an embodiment, the link(s) $2^{nd}$-WL(l,r) between the auxiliary device and the hearing devices is based on radiated fields (e.g. according to the Bluetooth standard, and/or based on audio transmission utilizing the Bluetooth Low Energy standard), but may alternatively be based on near-field communication (e.g. on inductive coupling). The bandwidth of the links is preferably adapted to allow sound source signals (or at least parts thereof, e.g. selected frequency bands and/or time segments) and/or localization parameters identifying a current location of a sound source to be transferred between the devices. In an embodiment, processing of the system (e.g. reverberation identification) and/or the function of a remote control is fully or partially implemented in the auxiliary device AD (SmartPhone).

Various aspects of inductive communication links (IA-WL) are e.g. discussed in EP 1 107 472 A2, EP 1 777 644 A1, US 2005/0110700 A1, and US2011222621A1. WO 2005/055654 and WO 2005/053179 describe various aspects of a hearing aid comprising an induction coil for inductive communication with other units. A protocol for use in an inductive communication link is e.g. described in US 2005/0255843 A1.

In an embodiment, the RF-communication link (WL-RF) is based on classic Bluetooth as specified by the Bluetooth Special Interest Group (SIG) (cf. e.g. https://www.bluetooth.org). In an embodiment, the (second) RE-communication link is based other standard or proprietary protocols (e.g. a modified version of Bluetooth, e.g. Bluetooth Low Energy modified to comprise an audio layer).

FIG. 7 shows a flow diagram for a method of reducing reverberation in an audio processing device according to an embodiment of the present disclosure. The method comprises steps S1-S12 as outlined in the following.

S1 providing a reverberation model for a sound comprising

S2 providing a time variant electric input signal representative of a sound;

S3 providing a processed representation of said electric input signal according to a first processing scheme;

S4 providing information about reverberation properties of the processed electric input signal at a given time instance;

S5 providing a predefined or an online calculated model of the likelihood that a specific slope of the processed representation of the electric input signal is due to reverberation based on said processed electric input signal and said information about reverberation properties;

S6 using the reverberation model on a current electric signal representative of sound S7 providing a time variant current electric input signal representative of a sound;

S8 providing a processed representation of said current electric input signal according to said first processing scheme;

S9 determining the likelihood that a specific slope of the processed representation of said current electric input signal at a given time instance is due to reverberation using said predefined or online calculated model;

S10 determining a resulting likelihood based on said current likelihood and corresponding likelihoods determined for a number of previous time instances;

S11 calculating an attenuation value of the current electric input signal at said time instance based on said resulting likelihood and characteristics of said processed representation of the electric input signal;

S12 applying said attenuation to the current electric input signal at said time instance providing a modified electric signal.

Some or the steps may, if convenient or appropriate, be carried out in another order than outlined above (or in parallel).

In summary, the present disclosure provides a method and device for reducing the effect of reverberation in an audio processing device, e.g. a hearing device, such as a hearing aid.

The scheme for attenuating reverberant parts of an electric input signal representing sound from an environment, comprises:

A. Creating or incorporating a model for the likelihood that a specific slope of a processed (e.g. logarithmic) representation of an electric input signal representing sound is due to reverberation.

B. Using the model on a current electric input signal to
- determine whether a specific slope of the processed representation of the current electric input signal at a given time instance (e.g. a given time sample, or a given time-frequency unit) is due to reverberation, to
- determine an attenuation of the current electric input signal for time instances identified as reverberant (typically leaving other time instances un-attenuated), and to
- apply the relevant attenuation to the current electric input signal at the corresponding time instances.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims and equivalents thereof. For example, to enhance other signals than signals containing reverberation, e.g. other types of noise having predictable characteristics.

The invention claimed is:

1. A method of reducing reverberation in a sound signal, the method comprising providing a reverberation model for a sound comprising providing a time variant electric input signal representative of a sound;

providing a processed representation of said electric input signal according to a first processing scheme;

providing information about reverberation properties of the processed electric input signal at a given time instance;

providing a predefined or an online calculated model of a likelihood that a specific slope of the processed representation of the electric input signal is due to reverberation based on said processed electric input signal and said information about reverberation properties;

using the reverberation model on a current electric signal representative of sound comprising providing a time variant current electric input signal representative of a sound;

providing a current processed representation of said current electric input signal according to said first processing scheme;

determining a current likelihood that a specific slope of the processed representation of said current electric input signal at a current given time instance is due to reverberation using said predefined or online calculated model;

determining a resulting likelihood based on said current likelihood and corresponding likelihoods determined for a number of previous time instances;

calculating an attenuation value of the current electric input signal at said current time instance based on said resulting likelihood and characteristics of said current processed representation of the electric input signal;

applying said attenuation to the current electric input signal at said current time instance providing a modified electric signal.

2. A method according to claim 1 wherein the time variant electric input signal is provided as a multitude of input frequency band signals.

3. A method according to claim 1 wherein said information about reverberation properties of the processed electric input signal at a given time instance includes a signal to reverberation ratio, a direct to reverberation ratio or an early to late reflection ratio.

4. A method according to claim 1 wherein the characteristics of the current processed representation of the current electric input signal depends on a noise floor of the signal.

5. A method according to claim 1 wherein the predefined or online calculated model used for identifying time instances of the current electric input signal being reverberant is dependent on characteristics of the current electric input signal.

6. A method according to claim 1 comprising determining characteristic of the current electric input signal indicative of a particular sound environment.

7. A method according to claim 1 wherein providing a processed representation of said electric input signal or of said current electric input signal according to the first processing scheme comprises providing a logarithmic representation of said electric input signal and/or of said current electric input signal, respectively.

8. A data processing system comprising a processor and program code means for causing the processor to perform the steps of the method of claim 1.

9. An audio processing device comprising an input unit providing a time variant current electric input signal representative of a sound;

a processor providing a current processed representation of said current electric input signal according to a first processing scheme;

a memory unit comprising a predefined or online calculated model of a likelihood that a specific slope of a processed representation of an electric input signal, processed according to said first processing scheme, is due to reverberation based on said processed electric input signal and information about reverberation properties of said processed electric input signal at a given time instance;

the processor being configured to determine a current likelihood that a specific slope of the processed representation of said current electric input signal at a current given time instance is due to reverberation using said predefined or online calculated model, to determine a resulting likelihood based on said current likelihood and corresponding likelihoods determined for a number of previous time instances; and to calculate an attenuation value of the current electric input signal at said current time instance based on said resulting likelihood and characteristics of said current processed representation of the electric input signal; and the audio processing device further comprising a gain unit for applying said attenuation value to the current electric input signal at said current time instance to provide a modified electric signal.

10. An audio processing device according to claim 9 comprising an output unit for presenting stimuli perceivable to a user as sound based on said modified electric signal.

11. An audio processing device according to claim 9 wherein said gain unit is adapted to further compensate for a user's hearing impairment.

12. An audio processing device according to claim 9 comprising a time to time-frequency conversion unit.

13. An audio processing device according to claim 9 comprising a classification unit for classifying a current sound environment of the audio processing device.

14. An audio processing device according to claim 9 comprising a level detector for determining the level of an input signal on a frequency band level and/or of the full signal.

15. An audio processing device according to claim 9 wherein said memory unit comprises a number of predefined or online calculated models, each model being associated with a particular sound environment or a particular listening situation.

16. An audio processing device according to claim 9 constituting or comprising a communication device or a hearing aid.

17. Use of an audio processing device as claimed in claim 9.

18. A non-transitory computer readable medium having stored thereon an application, termed an APP, comprising executable instructions configured to be executed on an auxiliary device to implement a user interface for the audio processing device according to claim 9.

19. A non-transitory computer readable medium according to claim 18 wherein the APP is configured to allow a user to select one out of a predefined set of environments to optimize the reverberation reduction settings by selecting one out of a number of appropriate models adapted for a particular acoustic environment, and/or algorithms and/or algorithm settings.

20. A non-transitory computer readable medium according to claim 18 wherein the APP is configured to receive inputs for one or more detectors sensing a characteristic reverberation in the present location, or from other 'classifiers' of the acoustic environment.

21. A non-transitory computer readable medium according to claim 20 wherein the APP is configured to propose an appropriate current environment.

* * * * *